US010444666B2

(12) United States Patent
Eda

(10) Patent No.: US 10,444,666 B2
(45) Date of Patent: Oct. 15, 2019

(54) IMAGE FORMING APPARATUS WITH REMOVABLE DEVELOPER CONTAINER

(71) Applicant: CANON KABUSHIKI KAISHA, Tokyo (JP)

(72) Inventor: Hiroyuki Eda, Moriya (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/139,457

(22) Filed: Sep. 24, 2018

(65) Prior Publication Data

US 2019/0094756 A1 Mar. 28, 2019

(30) Foreign Application Priority Data

Sep. 28, 2017 (JP) ..... 2017-188362

(51) Int. Cl.
*G03G 15/08* (2006.01)
*G03G 15/00* (2006.01)

(52) U.S. Cl.
CPC ..... *G03G 15/0865* (2013.01); *G03G 15/5016* (2013.01); *G03G 15/602* (2013.01)

(58) Field of Classification Search
None
See application file for complete search history.

(56) References Cited

U.S. PATENT DOCUMENTS

2019/0094781 A1* 3/2019 Eda ..... G03G 15/553

FOREIGN PATENT DOCUMENTS

JP 2015072313 A 4/2015

* cited by examiner

*Primary Examiner* — Sevan A Aydin
(74) *Attorney, Agent, or Firm* — Rossi, Kimms & McDowell LLP

(57) ABSTRACT

An image forming apparatus prevents sheets from remaining inside the image forming apparatus even when a container that is not empty is replaced with another container. The image forming apparatus includes a mount to which a container containing developer is mounted, and a replenishing unit replenishing an image forming unit with the developer from the mounted container. In a case where the mounted container is replaced with another one without replacement of the container necessary during image formation of the image forming unit, a controller suspends feeding of a sheet, discharges the sheet remaining in a conveying path, and disables an image forming operation. A display displays a screen for prompting replacement of the mounted container if replacement of the container is necessary, and displays a screen for prompting re-mounting of the replaced container in a case where the mounted container is replaced without replacement of the container necessary.

11 Claims, 10 Drawing Sheets

△TONER BOTTLE THAT CAN BE USED CONTINUOUSLY WAS REMOVED.

PLEASE RE-MOUNT THE REMOVED TONER BOTTLE.
THANK YOU FOR YOUR COOPERATION IN EFFECTIVELY UTILIZING LIMITED RESOURCES.

*FIG. 7*

△ THERE IS NO TONER IN BOTTLE.

IT CAN BE REPLACED WITH
NEW TONER BOTTLE.

CLOSE

*FIG. 8*

△ THERE IS NO TONER.

PLEASE MOUNT NEW TONER BOTTLE.

*FIG. 9*

△ TONER BOTTLE THAT CAN BE USED CONTINUOUSLY WAS REMOVED.

PLEASE RE-MOUNT THE REMOVED TONER BOTTLE.
THANK YOU FOR YOUR COOPERATION IN EFFECTIVELY UTILIZING LIMITED RESOURCES.

JOB PROCESS
S201
WARNING DISPLAY BEING DISPLAYED?
YES
NO
FEED SHEET
S202
FORM IMAGE
S203
DISCHARGE SHEET
S204
S205
REPLENISHMENT WITH TONER NEEDED?
NO
YES
REPLENISH WITH TONER
S206
S207
BUFFER EMPTY OF TONER?
NO
YES
DISPLAY REPLACEMENT SCREEN
S208
S209
NEXT PAGE ABSENT?
NO
YES
S210
SUSPEND IMAGE FORMATION
SUSPEND IMAGE FORMATION
S211
DISABLE IMAGE FORMATION
S212
END

IMAGE FORMING APPARATUS WITH REMOVABLE DEVELOPER CONTAINER

BACKGROUND OF THE INVENTION

Field of the Invention

The present invention relates to an image forming apparatus with a removable developer container which contains a developer.

Description of the Related Art

An electronic image forming apparatus forms an image by developing an electrostatic latent image, which is formed on a photosensitive material, with a developer in a developing device. The amount of developer that can be stored in the developing device is limited, and hence the developing device is replenished as appropriate with a developer from a container removable from the image forming apparatus. It should be noted that the amount of developer in the developing device is limited as well, and therefore, when there is no developer in the container, the developing device cannot be replenished with a developer from the container.

There is also known an image forming apparatus capable of continuing an image forming operation even in a state where the container is removed. Namely, a user is allowed to replace the container without interrupting the image forming operation.

Here, there may be cases where the user replaces the container even though the amount of developer in the container is equal to or more than a predetermined amount. Thus, an image forming apparatus described in Japanese Laid-Open Patent Publication (Kokai) No. 2015-72313 disables an image forming operation when the container is removed before it becomes empty. According to the image forming apparatus described in Japanese Laid-Open Patent Publication (Kokai) No. 2015-72313, an image forming operation is enabled by re-mounting a container that is not empty, and therefore, a container with a developing agent still remaining is prevented from being discarded.

However, the image forming apparatus described in Japanese Laid-Open Patent Publication (Kokai) No. 2015-72313 may stop in a state where sheets remain inside the image forming apparatus when a toner bottle that has not become empty yet is replaced with another toner bottle during an image forming operation. If sheets remain in the image forming apparatus, a user has to re-mount the original toner bottle, and in addition to that, remove the sheets remaining inside the image forming apparatus, which is cumbersome and complicated.

SUMMARY OF THE INVENTION

The present invention provides an image forming apparatus which prevents sheets from remaining inside the image forming apparatus even when a toner bottle that is not empty is replaced with another toner bottle.

Accordingly, in an aspect of the present invention, there is provided An image forming apparatus comprising: a conveying unit configured to feed a sheet to convey the sheet along a conveying path; an image forming unit configured to form an image on the sheet using a developer; a mount to which a container is mounted, the container containing the developer; a replenishing unit configured to replenish the image forming unit with the developer from the mounted container; a controller configured to judge whether or not replacement of the mounted container is necessary, and in a case where the mounted container is replaced with another one without replacement of the container necessary during image formation operation by the image forming unit, (i) suspend feeding of the sheet by the conveying unit, (ii) discharge the sheet remaining in the conveying path, and (iii) disable an image forming operation of the image forming unit; and a display configured to display a screen for prompting replacement of the mounted container if replacement of the container is necessary, and display a screen for prompting re-mounting of the replaced container in a case where the mounted container is replaced with another one without replacement of the container necessary.

According to the present invention, sheets are prevented from remaining inside the image forming apparatus even when a toner bottle that is not empty is replaced with another toner bottle.

Further features of the present invention will become apparent from the following description of exemplary embodiments (with reference to the attached drawings).

BRIEF DESCRIPTION OF THE DRAWINGS

FIG. 7 is a view showing an example of a replaceable screen.

FIG. 8 is a view showing an example of a replacement screen.

FIG. 9 is a view showing an example of a warning screen.

DESCRIPTION OF THE EMBODIMENTS

The present invention will now be described in detail below with reference to the accompanying drawings showing embodiments thereof.

First Embodiment

Figure 1:
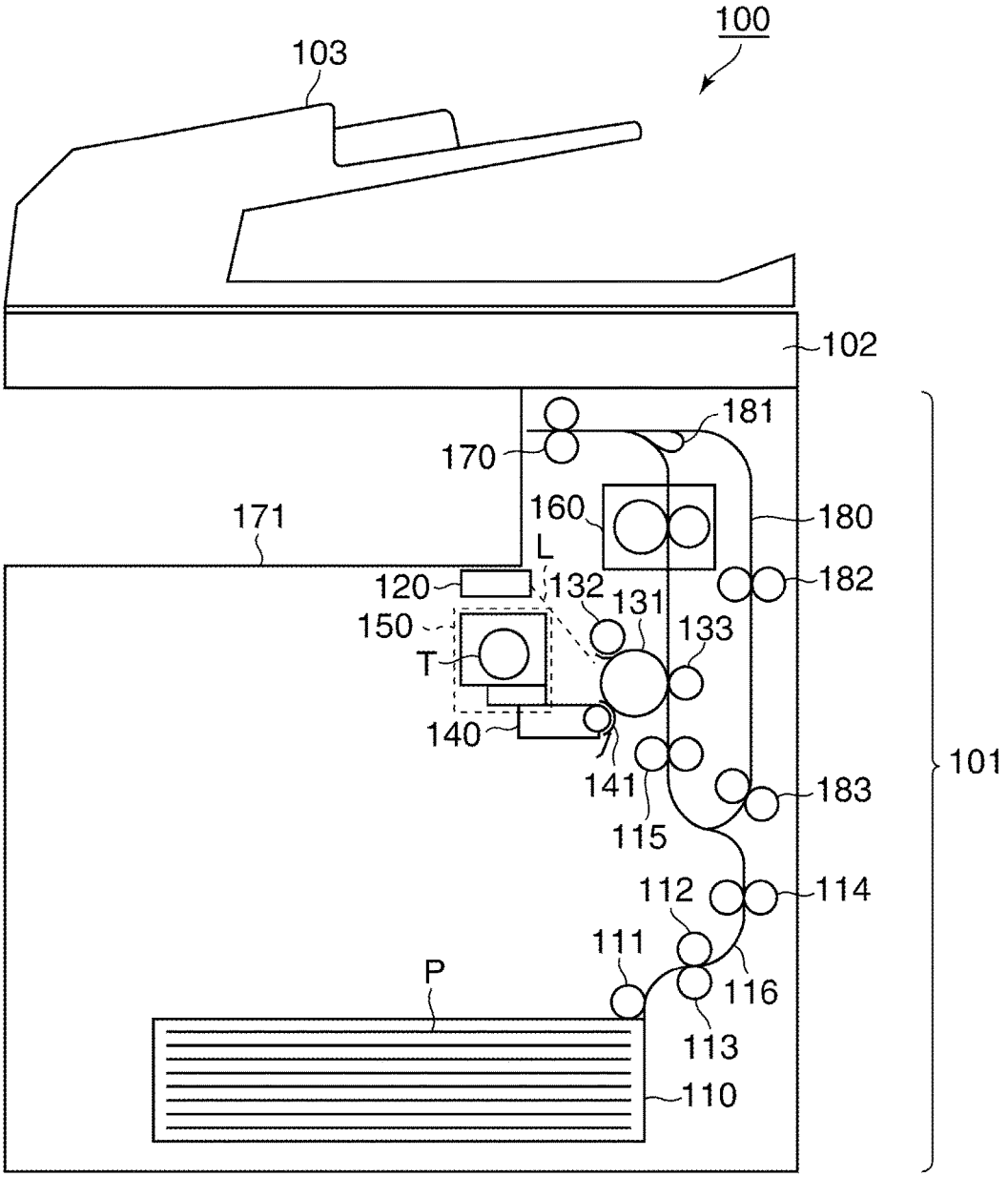
FIG. 1 is a cross-sectional view schematically showing an arrangement of an image forming apparatus.

FIG. 1 is a cross-sectional view schematically showing an arrangement of an image forming apparatus according to a first embodiment of the present invention. This image forming apparatus 100 has a printer 101 that forms images on sheets, a reader 102 that reads images off originals, and an ADF unit 103 that conveys originals to be read.

In the printer 101, sheets P housed in a sheet feed cassette 110 are fed one by one by a pickup roller 111, a sheet feed roller 112, and a retard roller 113. The sheets P fed from the sheet feed cassette 110 are conveyed along a conveying path 116 by conveying rollers 114 as a conveying unit. When the sheets P reaches a location of a registration roller pair 115, skew is corrected for by the registration roller pair 115 being at a standstill. After that, rotation of the registration roller pair 115 is started, causing the sheet P to be conveyed to a transfer nip area between a photosensitive drum 131 and a transfer roller 133.

The printer 101 has a laser scanner 120, the photosensitive drum 131, a charging roller 132, the transfer roller 133, and a developing device 140. They constitute an essential part of an image forming means for forming images on sheets. The printer 101 forms images on the sheets P. In the printer 101, an outer peripheral surface of the photosensitive drum 131, which is rotatively driven, is uniformly charged to a potential of a predetermined polarity by an action of the charging roller 132. The laser scanner 120 exposes the charged photosensitive drum 131 to light with a light beam (laser light). Specifically, the laser scanner 120 outputs laser light L modulated according to image information (time-series digital pixel signals) and scans the charged photosensitive drum 131 with the laser light L to form an electrostatic latent image on the photosensitive drum 131. It should be noted that the laser scanner 120 outputs the laser light L based on image data (image information) obtained by the reader 102 reading an image an original or image data received from an external apparatus such as a PC via a network.

The developing device 140 stores a developer. A toner bottle T that is a container containing a developer (toner) is removable from a toner replenishment unit 150. The toner replenishment unit 150 acts as a mounting unit (mount) to which the toner bottle T is mounted. The developing device 140 includes a developing roller 141 and forms a toner image by developing the electrostatic latent image on the photosensitive drum 131 by toner supplied (added) from the toner replenishment unit 150. Accordingly, toner appropriate to image data is discharged from the developing device 140. The toner image formed on the photosensitive drum 131 moves to the transfer nip area with rotation of the photosensitive drum 131. A transfer bias of an opposite polarity to that of the photosensitive drum 131 is applied to the transfer roller 133, and in the transfer nip area, the toner image on the photosensitive drum 131 is transferred to a surface of the sheet P.

In the printer 101, the sheet P to which the toner image has been transferred is conveyed into a fixing device 160. The fixing device 160 fixes the toner image onto the sheet P by applying heat and pressure using a fixing heater and a pressurization roller. The sheet P on which the image has been formed in this manner is discharged onto a discharged sheet tray 171 outside the image forming apparatus by sheet discharging rollers 170.

In a case where double-sided printing is performed on the sheet P, the sheet P on which image formation on its first side has been completed passes through a location of an inversion flapper 181, is then conveyed in an opposite direction by the sheet discharging rollers 170, and guided to an inversion conveying path 180. The sheet P guided to the inversion conveying path 180 is conveyed again to the registration roller pair 115 by conveying rollers 182 and 183. On this occasion, the first side and the second side of the sheet P are inverted as compared to those during the image formation on the first side. Then, image formation is performed on the second side of the sheet P as with the above described image formation on the first side, and after that, the sheet P is discharged onto the discharged sheet tray 171.

Figure 2:
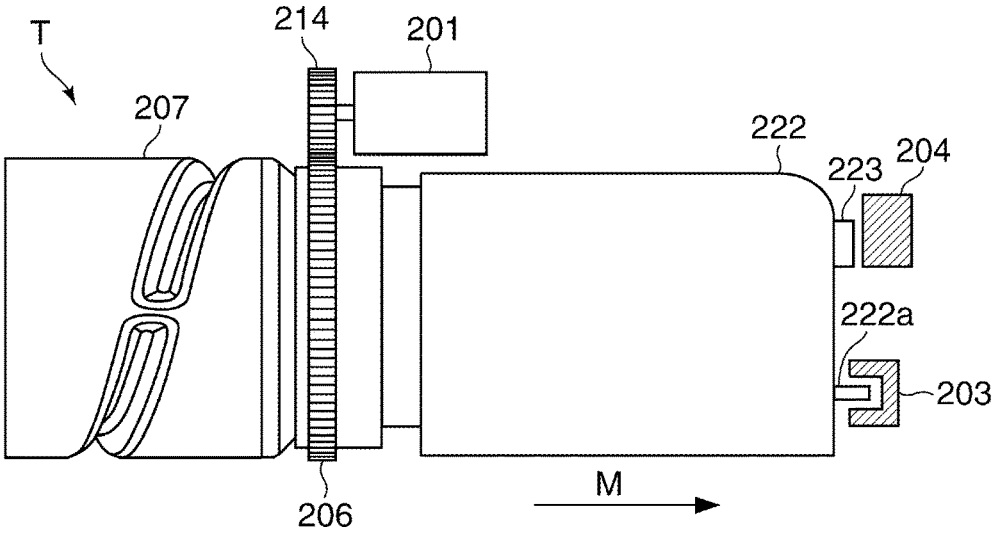
FIG. 2 is an external view of a toner bottle.

FIG. 2 is an external view of the toner bottle T mounted to the toner replenishment unit 150 of the image forming apparatus 100. The toner bottle T has a cap unit 222, a container unit 207 that contains toner, a drive transmission unit 206 to which torque is transmitted from a bottle motor 201, and a discharge port (not shown) from which toner is discharged. The cap unit 222 has a projection 222*a* on a rear side in a direction in which the toner bottle T is mounted (a direction indicated by an arrow M). Upon detecting the projection 222*a* of the cap unit 222, a bottle sensor 203, which acts as a detection unit provided in the image forming apparatus 100, outputs a signal indicating that the toner bottle T is mounted. A memory 223 in which information on the toner bottle T is recorded is attached to the cap unit 222.

Figure 3:
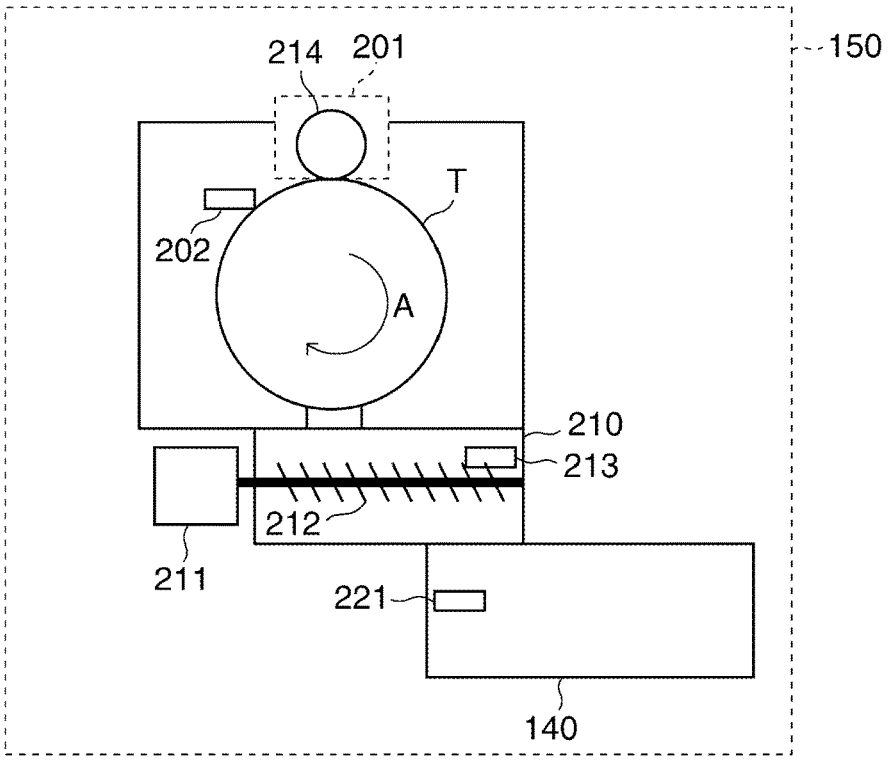
FIG. 3 is a view schematically showing an arrangement of a toner replenishment unit.

FIG. 3 is a view schematically showing an arrangement of the toner replenishment unit 150 in the image forming apparatus 100. The toner bottle T that is filled with toner in advance is placed in the toner replenishment unit 150 by a user. The toner replenishment unit 150 has the toner bottle T, the bottle motor 201, a buffer 210, and a motor 211. The buffer 210 acts a buffer unit in which toner discharged from the toner bottle T is temporarily stored. The buffer 210 is a part of the developing device 140.

The drive transmission unit 206 (FIG. 2) of the toner bottle T is connected to the bottle motor 201 via a drive gear train 214, and the bottle motor 201 applies torque to the drive transmission unit 206. Running the bottle motor 201 causes the toner bottle T to rotate in a direction indicated by an arrow A. The rotation of the toner bottle T causes toner to be discharged from the toner bottle T and flow into the buffer 210. A screw 212 is provided in the buffer 210. A rotary shaft of the screw 212 is connected to the motor 211 via a drive gear train (not shown), and the motor 211 applies torque to the rotary shaft of the screw 212 via the drive gear train. By rotating, the screw 212 conveys the toner, which has flown into the buffer 210, in one direction (from left to right as viewed in FIG. 3). At an end of the buffer 210, the toner conveyed through the buffer 210 is added to the developing device 140. The bottle motor 201, the motor 211, and the buffer 210 correspond to a replenishing unit of the present invention.

The toner replenishment unit 150 has an HP sensor 202 that is a bottle home position sensor, and a second toner sensor 213 that is a second sensor. The HP sensor 202 is for detecting a reference position for rotation of the toner bottle T and used to control rotation of the toner bottle T. The second toner sensor 213 is placed in the buffer 210. A first toner sensor 221 which is a first sensor for detecting the presence or absence of toner in the developing device 140 is provided in the developing device 140.

Figure 4:
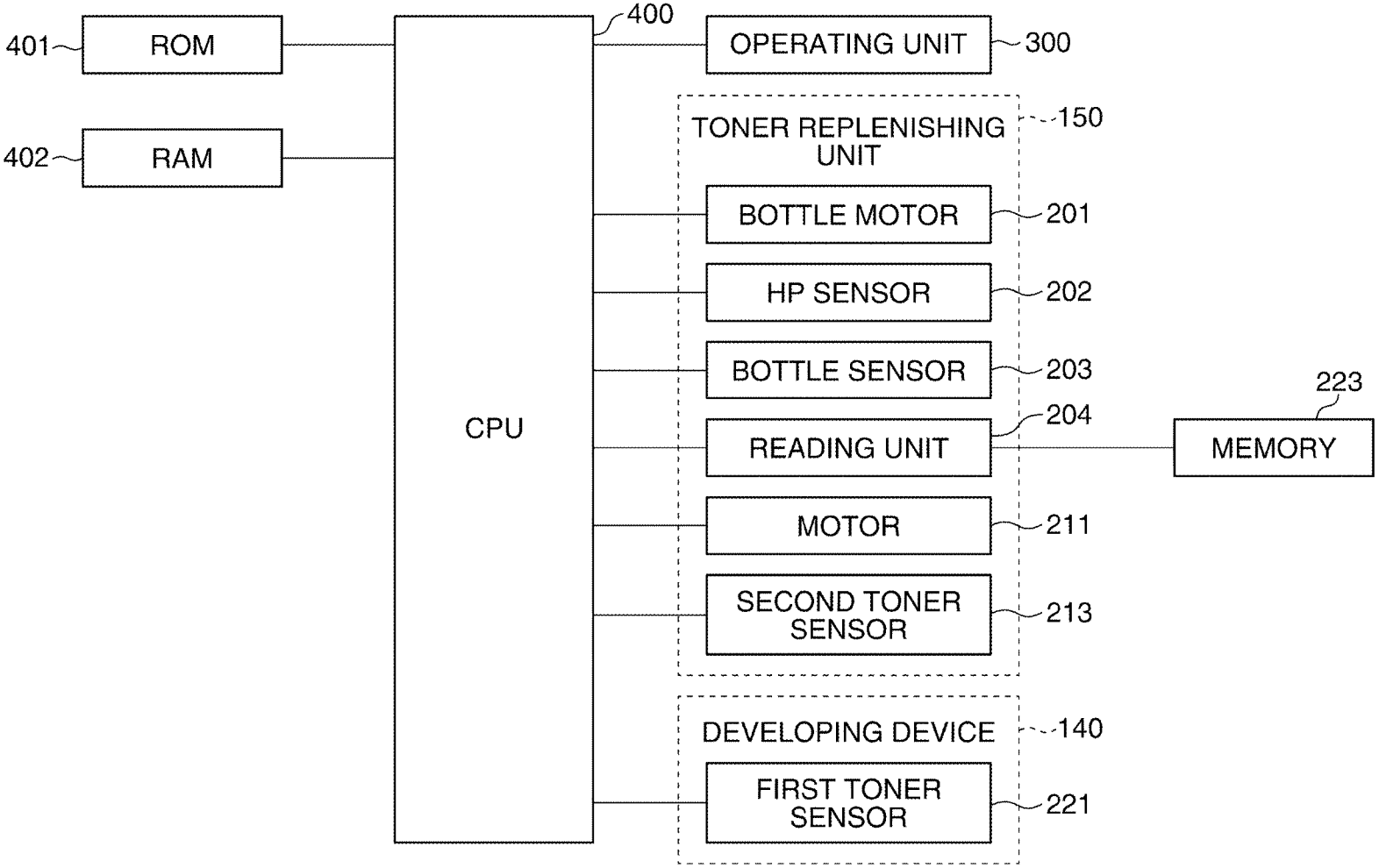
FIG. 4 is a control block diagram of the image forming apparatus.

FIG. 4 is a control block diagram of the image forming apparatus 100. The image forming apparatus 100 has a CPU 400, a ROM 401, and a RAM 402. The ROM 401 stores control programs for controlling the overall image forming apparatus 100. The RAM 402, which is a volatile storage device, is used as a work area for the CPU 400 and also used to temporarily store a variety of data such as image data. The CPU 400 controls the overall image forming apparatus 100 by reading the control programs stored in the ROM 401 into the RAM 402 and executing them.

The CPU 400 controls operation of the toner replenishment unit 150 by controlling operation of the bottle motor 201 and the motor 211. Signals output from the HP sensor 202, the bottle sensor 203, and the second toner sensor 213 of the toner replenishment unit 150 and signals output from the first toner sensor 221 of the developing device 140 are input to the CPU 400.

A reading unit 204 (FIG. 2) is an obtaining unit for reading "replenishment information" recorded in the memory 223 of the toner bottle T mounted at the mounting position of the image forming apparatus 100 and notifying the CPU 400 of the replenishment information. The reading unit 204 is also able to write the replenishment information provided by the CPU 400 into the memory 223 of the toner bottle T. The replenishment information includes, for example, a serial number of the toner bottle T, a history of replenishments using the toner bottle T, and a judgment result showing whether or not the toner bottle T is empty of toner. Serial numbers are assigned to the respective toner bottles T and used as identification information for uniquely identifying the respective toner bottles T. The CPU 400 identifies the toner bottles T by the serial numbers. It should be noted that the history of replenishments by the toner bottle T is, for example, the number of turns of the toner bottle T. Each time the toner bottle T is turned one turn, the CPU 400 causes the reading unit 204 to record information on the number of turns of the toner bottle T in the memory 223. The number of turns of the toner bottle T corresponds to the number of replenishments with toner from the toner bottle T.

An operating unit 300 has a touch panel (screen) that is a display unit. The touch panel of the operating unit 300 displays a home screen, a replacement screen, a warning screen, and so forth according to signals from the CPU 400. The touch panel of the operating unit 300 also notifies the user of statuses of the image forming apparatus 100 according to signals from the CPU 400. It should be noted that the arrangement that displays the screens mentioned above should not always be the touch panel but may be a monitor of a PC connected to the image forming apparatus 100 such that they are able to communicate with each other via a network.

Figure 5A:
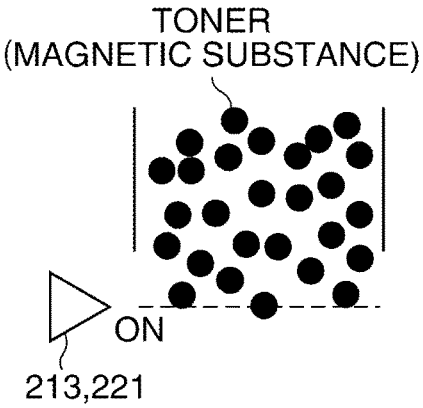
FIGS. 5A to 5C are views showing how toner sensors detect toner.
Figure 5B:
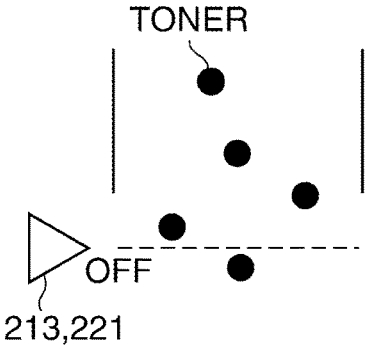
Figure 5C:
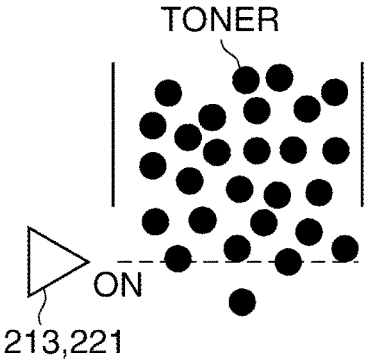

Referring to FIGS. 5A, 5B, and 5C, a description will now be given of how the first toner sensor 221 and the second toner sensor 213 detect the presence or absence of toner. FIGS. 5A to 5C are views showing how the toner sensors 221 and 213 detect moving toner. Both the second toner sensor 213 provided in the buffer 210 and the first toner sensor 221 provided in the developing device 140 are magnetic permeability sensors. As shown in FIGS. 5A and 5C, when the toner sensors 221 and 213 detect toner including magnetic substances, they output an on-state signal, and when they detect no toner as shown in FIG. 5B, they output an off-state signal. Namely, each of the toner sensors 221 and 213 outputs a signal indicating whether or not toner is detected.

Here, the toner sensor 221 is provided at a predetermined height from a bottom of the developing device 140 as viewed in a direction of gravity. For this reason, when the toner sensor 221 detects toner, a predetermined amount or more of toner has been accumulated in the developing device 140. The toner sensor 213 is also provided at a predetermined height from a bottom of the buffer 210 in a direction of gravity. For this reason, when the toner sensor 213 detects toner, a predetermined amount or more of toner has been accumulated in the buffer 210. It should be noted that the height from the bottom of the developing device 140 and the height from the bottom of the buffer 210 should be determined as appropriate.

In the present embodiment, by monitoring output signals from the second toner sensor 213 and the first toner sensor 221 at intervals of 100 msec, the CPU 400 judges the presence or absence of toner in the developing device 140 and the buffer 210. When the second toner sensor 213 has detected no toner a predetermined number of times in a row, the CPU 400 judges that there is no toner in the buffer 210. This corresponds to a case where signals from the second toner sensor 213 obtained at the monitoring intervals are in the OFF state a predetermined number of times in sequence, and an output from the second toner sensor 213 indicates a detection result showing that "there is no toner in the buffer 210". Likewise, when the first toner sensor 221 has detected no toner a predetermined number of times in a row, the CPU 400 judges that there is no toner in the developing device 140. This corresponds to a case where signals from the first toner sensor 221 obtained at the monitoring intervals are in the OFF state a predetermined number of times in a row, and an output from the first toner sensor 221 indicates a detection result showing that "there is no toner in the developing device 140".

It should be noted that the toner presence or absence detection process described above is an example, and other processes may be adopted. An arrangement that detects the presence or absence of toner by applying piezoelectric sensors to the toner sensors 221 and 213 may also be adopted.

Figure 6A:
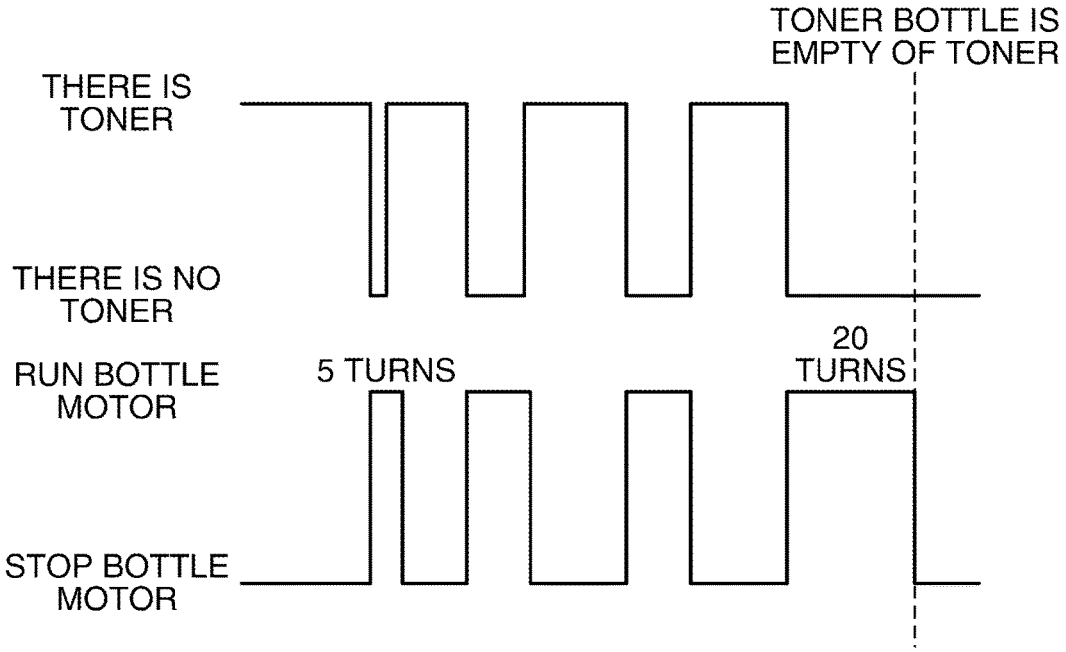
FIGS. 6A and 6B are views showing sequences of judgment as to whether or not a toner bottle and a buffer are empty.

FIG. 6A is a view showing a sequence of judgment as to whether or not the toner bottle T is empty of toner. Referring to FIG. 6A, a description will be given of a process in which it is judged whether or not the toner bottle T is empty of toner. As described earlier, during image formation, toner appropriate to image data is discharged from the developing device 140. When it is judged that there is no toner in the developing device 140, the developing device 140 is replenished with toner from the buffer 210. As the replenishment of the developing device 140 with toner from the buffer 210 is repeated, it is judged in the end that there is no toner in the buffer 210 based on a result of detection by the second toner sensor 213 in the buffer 210.

Upon judging that there is no toner in the buffer 210, the CPU 400 turns the toner bottle T by controlling the bottle motor 201. As a result, toner is appropriately added to the buffer 210 from the toner bottle T, and in the end, a result of detection by the second toner sensor 213 shows that "there is toner in the buffer 210". Namely, the CPU 400 controls the bottle motor 201 such that the amount of toner in the buffer 210 is maintained at an appropriate amount. In the example shown in FIG. 6A, turning the bottle motor 201, for example, five turns causes the result of detection by the second toner sensor 213 to change from the absence of toner to the presence of toner.

Here, if the amount of toner in the toner bottle T becomes equal to or smaller than a predetermined amount, no toner would be added to the buffer 210 even if the toner bottle T is turned. As shown in FIG. 6A, even if the toner bottle T is turned, for example, 20 turns, a result of detection by the second toner sensor 213 continuously shows the absence of toner in the buffer 210. In this case, the CPU 400 judges that the toner bottle T (container) has become empty of toner. Then, the CPU 400 writes toner empty information=1, which indicates that the toner bottle T is empty of toner, as the replenishment information into the memory 223 of the toner bottle T. The CPU 400 also stores the toner empty information=1 in replenishment information on the toner bottle T stored in the RAM 402 which is a storage unit. It should be noted that toner empty information in replenishment information on the toner bottle T that is new is toner empty information=0, which indicates that the toner bottle T is not empty.

It should be noted that turning the toner bottle T 20 turns corresponds to a predetermined replenishing operation in which the buffer 210 is replenished with toner from the toner bottle T. Thus, when an output from the second toner sensor 213 indicates a result of detection showing that there is no toner in the buffer 210, it is judged that the toner bottle T is empty of toner unless the output from the second toner sensor 213 has changed even if the predetermined replenishing operation is performed. Here, if a remaining amount of toner in the toner bottle T becomes smaller than a predetermined amount of toner, even 20 turns of the toner bottle T with the toner sensor 213 detecting the "absence of toner" never causes an output of the toner sensor 213 to be changed to the "presence of toner". That is, the CPU 400 judges, based on a detection result of the toner sensor 213, whether or not a remaining amount of toner is more than a predetermined amount of toner, and then judges, if the remaining amount of toner in the toner bottle T is smaller than a predetermined amount of toner, that there is no toner in the toner bottle T. The CPU 400 then writes information indicating that the toner bottle T is empty of toner into the memory 223 of the toner bottle T. It should be noted that the number of turns in the predetermined replenishing operation is not limited to 20 which is given as an example above.

The second toner sensor 213 detects the presence or absence of toner based on a reference amount. Thus, when the absence of toner in the buffer 210 is detected, it does not always mean that there is no toner in the buffer 210. Therefore, even when it is judged that the toner bottle T is empty of toner, an image forming operation may be continued as long as toner remains in the buffer 210 even though the amount thereof is not more than the reference amount.

Figure 6B:
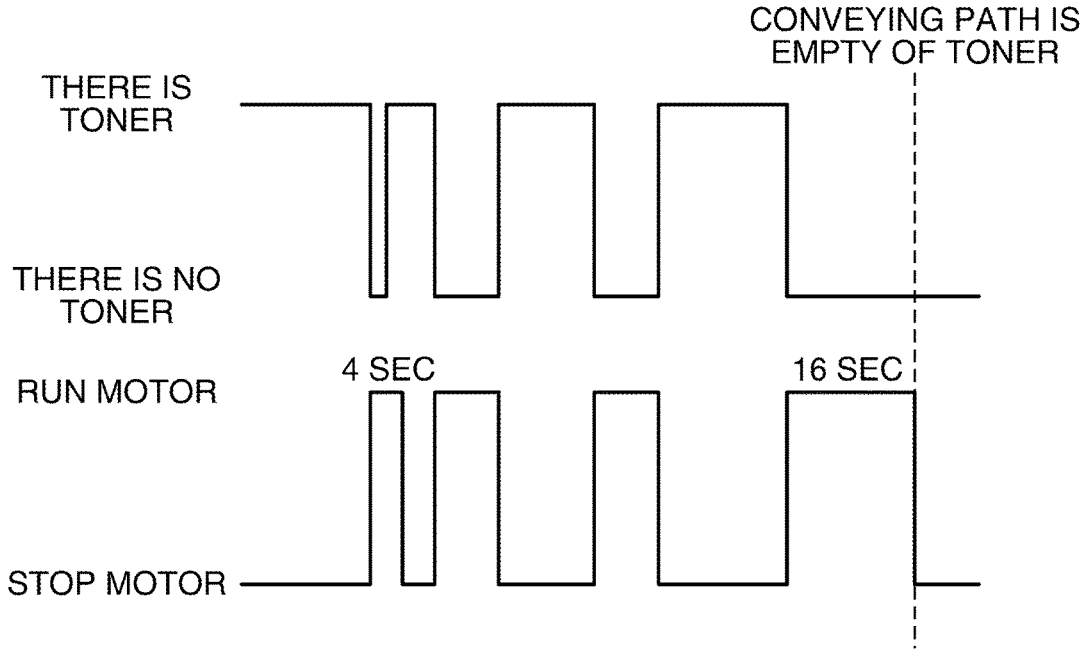

FIG. 6B is a view showing a sequence of judgment as to whether or not the buffer 210 is empty of toner. As described earlier, during image formation, toner appropriate to image data is discharged from the developing device 140. The first toner sensor 221 detects the presence or absence of toner in the developing device 140 based on the reference amount. When a remaining amount of toner becomes smaller than the reference amount due to discharging of toner from the developing device 140, the first toner sensor 221 outputs an OFF-state signal. Then, as described above, when an output from the first toner sensor 221 indicates that a detection result showing that there is no toner in the buffer 210, the CPU 400 controls the motor 211 to rotate the screw 212. For example, the CPU 400 controls the motor 211 for four seconds. This operation corresponds to a predetermined replenishing operation in which the developing device 140 is replenished with toner from the buffer 210. It should be noted that the time period during which the motor 211 is run is not limited to four seconds.

When the developing device 140 has been appropriately replenished with toner, an output from the first toner sensor 221 indicates that a detection result showing that there is toner in the buffer 210. Thus, the CPU 400 controls the motor 211 such that the amount of toner in the developing device 140 is maintained at a fixed amount (reference amount). Referring to FIG. 6B, by running the motor 211 for four seconds, the result of detection by the first toner sensor 221 changes from the absence of toner to the presence of toner.

When the buffer 210 has become empty of toner, no toner is added to the developing device 140 even by running the motor 211. As shown in FIG. 6B, even if the motor 211 is run for 16 seconds, the result of detection by the first toner sensor 221 continuously shows that there is no toner in the buffer 210. In this case, the CPU 400 judges that the buffer 210 (buffer unit) has become empty of toner. Thus, when an output from the first toner sensor 221 indicates that a detection result showing that there is no toner in the developing device 140, it is judged that there is no toner in the buffer 210 as long as the output from the first toner sensor 221 has not changed even if the predetermined replenishing operation is performed.

FIG. 7 is a view showing an example of a replaceable screen. This replaceable screen is displayed on the touch panel of the operating unit 300 when it is judged that the toner bottle T is empty of toner. This replaceable screen notifies the user that the toner bottle T is empty of toner and that the toner bottle T is replaceable with a new toner bottle T. The user is allowed to replace the toner bottle T even while image formation continues (this is called "continuous running"). When the user depresses "Close" button on the replaceable screen, the CPU 400 erases the replaceable screen on the touch panel and displays a home screen instead. The home screen is different from a replacement screen (FIG. 8) and a warning screen (FIG. 9), to be described later. On the home screen, for example, the user is allowed to change print settings on the image forming apparatus 100 and set, for example, the number of copies, density of printed matter, and print mode. Therefore, even when it is judged that the toner bottle T is empty of toner, the user is allowed to set a print mode via the home screen as long as toner remains in the buffer 210.

FIG. 8 is a view showing an example of the replacement screen. This replacement screen is displayed on the touch panel of the operating unit 300 when it is judged that the buffer 210 is empty of toner. Here, if an amount of a developer (toner) in the buffer 210 is smaller than a reference amount of toner, the buffer 210 is empty of toner. This replacement screen notifies the user that the buffer 210 has become empty of toner and that the toner bottle T needs to be replaced with a new toner bottle T. This prompts the user to replace the toner bottle T. In accordance with an instruction on the replacement screen, the user removes (detaches) the toner bottle T from the image forming apparatus 100 and mounts the new toner bottle T. When the mounting of the toner bottle T is detected by the bottle sensor 203 after the removal of the toner bottle T is detected by the bottle sensor 203, the CPU 400 erases the replacement screen on the touch panel and displays the home screen instead.

It should be noted that immediately after the toner bottle T is replaced with the replacement screen, the developing device 140 and the buffer 210 are usually empty. For this reason, first, the CPU 400 controls the bottle motor 201 to replenish the buffer 210 with toner from the toner bottle T. Next, when an output from the second toner sensor 213 indicates that there is toner in the buffer 210, the CPU 400 controls the motor 211 to start replenishing the developing device 140 with toner from the buffer 210. After that, when it is judged that there is toner in the developing device 140, the image forming apparatus 100 is ready to perform an image forming operation.

FIG. 9 is a view showing an example of the warning screen. This warning screen is for notifying the user that the toner bottle T which has been removed without the toner bottle T empty should be re-mounted. If the toner bottle T is removed before it is judged that the toner bottle T is empty of toner in the above described sequence of judgment as to whether the toner bottle T is empty of toner (FIG. 6A), the toner bottle T may be discarded as it is. Thus, upon judging that the toner bottle T has been removed although it is not empty and replaced with another toner bottle T from a result of detection by the bottle sensor 203, the CPU 400 displays the warning screen on the touch panel of the operating unit 300. On the warning screen, a message that prompts re-mounting of the removed toner bottle T is displayed on the warning screen. This prevents the user from erroneously removing and discarding the toner bottle T which does not require replacement. When the user re-mounts the removed toner bottle T, the warning screen disappears, the home screen is displayed on the touch panel, and the image forming operation is enabled.

Figure 10:
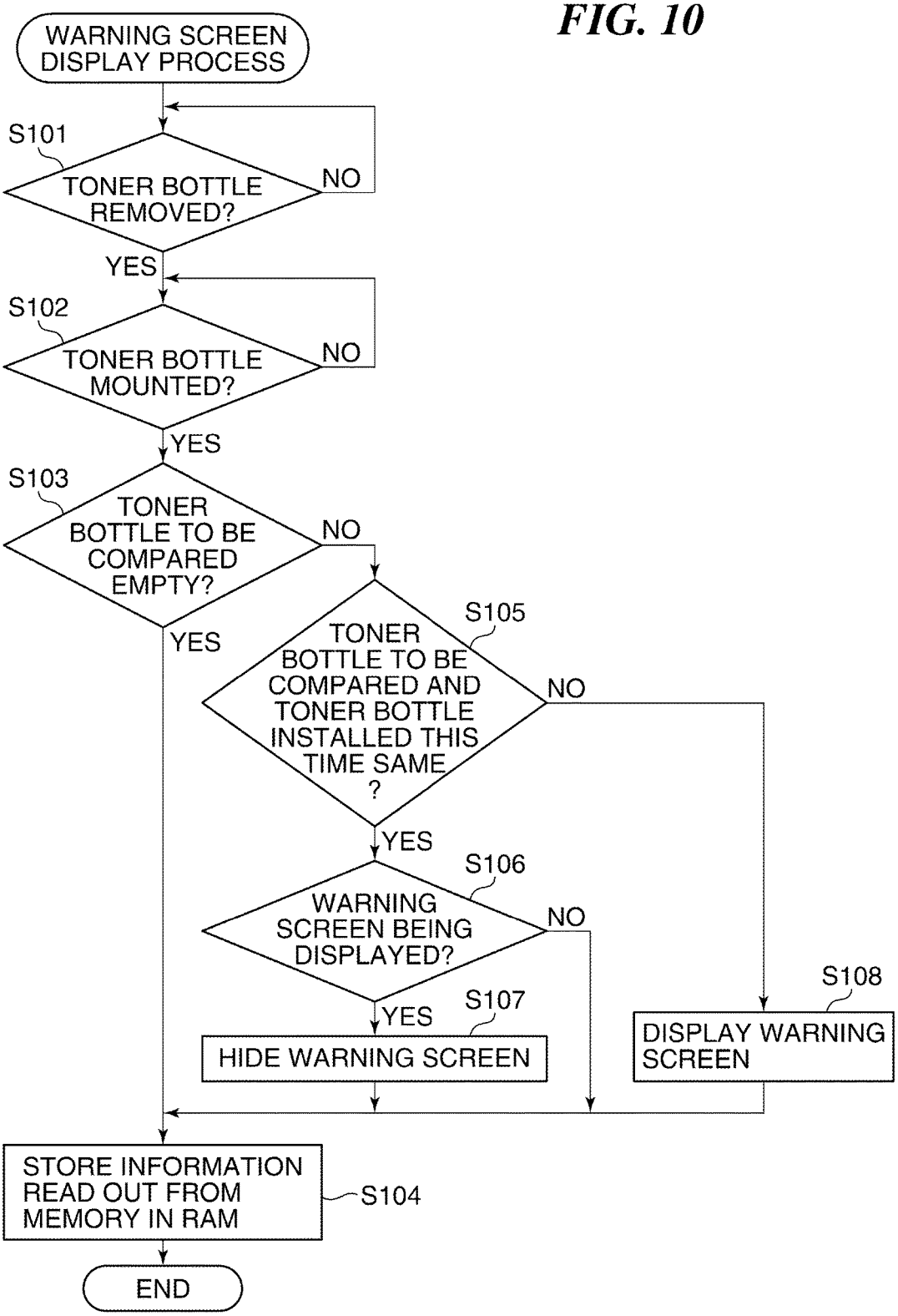
FIG. 10 is a flowchart of a warning screen display process.

FIG. 10 is a flowchart of a warning screen display process. This process is implemented by the CPU 400 reading programs stored in the ROM 401 into the RAM 402 and executing them. After the main power to the image forming apparatus 100 is turned on, the CPU 400 carries out this process at regular time intervals (for example, at intervals of 500 msec). In the process in FIG. 10, the CPU 400 acts as a judgment means of the present invention.

In step S101, based on a result of detection by the bottle sensor 203, the CPU 400 determines whether or not the toner bottle T has been removed. When the toner bottle T has been removed, the process proceeds to step S102. It should be noted that when the toner bottle T has been removed, the CPU 400 holds replenishment information (including a model number), which was obtained from the toner bottle T before it was removed, in the RAM 402 without erasing it.

In the step S102, based on a result of detection by the bottle sensor 203, the CPU 400 determines whether or not the toner bottle T has been mounted. When the toner bottle T has been mounted, the process proceeds to step S103. In the step S103, the CPU 400 determines whether or not the toner bottle T to be compared with the toner bottle T that has been newly mounted was empty. Here, when the warning screen is not being displayed, the toner bottle T mounted previously (removed last) corresponds to "the toner bottle T to be compared" used in the steps S103 and S104. When the warning screen is being displayed, the toner bottle T removed last before the warning screen is displayed (that is, the toner bottle T removed without the toner bottle T empty corresponds to the toner bottle T to be compared. There may be cases where the toner bottle T removed last before the warning screen is displayed is the same as the toner bottle T mounted previously. As a result of the determination in the step S103, the toner bottle T to be compared was empty (the toner empty information=1 is stored), the process proceeds to step S104. On the other hand, the toner bottle T to be compared was not empty (the toner empty information=0 is stored), the process proceeds to step S105. It should be noted that as a result of the determination in the step S103, when the toner bottle T to be compared was empty, it means that this toner bottle T satisfies a replacement condition.

In the step S105, the CPU 400 determines whether or not the toner bottle T to be compared and the toner bottle T mounted this time are the same by comparing model numbers in replenishment information on both of them. When the model numbers do not match, it is determined that they are different toner bottles T, and hence the CPU 400 causes the operating unit 300 to display the warning screen (FIG. 9) (step S108), followed by the process proceeding to the step S104. This corresponds to a case where the toner bottle T was replaced with another toner bottle T even though the replacement condition was not satisfied. On the other hand, when the model numbers match, it is determined that they are the same toner bottle T. Namely, it is judged that the toner bottle T was removed once and re-mounted. Then, the CPU 400 determines whether or not the warning screen is being displayed (step S106), and when the warning screen is not being displayed, the process proceeds to the step S104. On the other hand, when the warning screen is being displayed, the CPU 400 hides the warning screen (step S107), followed by the process proceeding to the step S104.

In the step S104, the CPU 400 obtains replenishment information recorded in the memory 223 of the toner bottle T newly mounted this time and updates replenishment information on the toner bottle T currently stored in the RAM 402 with the newly obtained replenishment information. More specifically, in the step S104, the CPU 400 performs processing as explained hereafter. First, in a case where the warning screen has been displayed (step S108), the CPU 400 separately stores the newly obtained replenishment information without deleting replenishment information on "the toner bottle T removed last before the warning screen was displayed". In a case where a model number in the replenishment information on "the toner bottle T removed last before the warning screen was displayed" is held, this information is used as identification information on the toner bottle T to be compared next time. Thus, the toner bottle T removed last before the warning screen was displayed is the toner bottle T to be compared in the subsequent steps S103 and S105. On the other hand, in a case where the warning screen has been hidden (step S107), the CPU 400 deletes the replenishment information on "the toner bottle T removed last before the warning screen was displayed". In this case, a model number in the updated replenishment information is used as identification information on the toner bottle T to be compared next time. Thus, the toner bottle T mounted this time is the toner bottle T to be compared in the steps S103 and S105 immediately after this toner bottle T is removed.

According to the process in FIG. 10, when the toner bottle T that is not empty is replaced with another toner bottle T, the warning screen is displayed. After that, when the toner bottle T that is not empty and removed once is re-mounted, the warning screen is erased.

Figure 11:
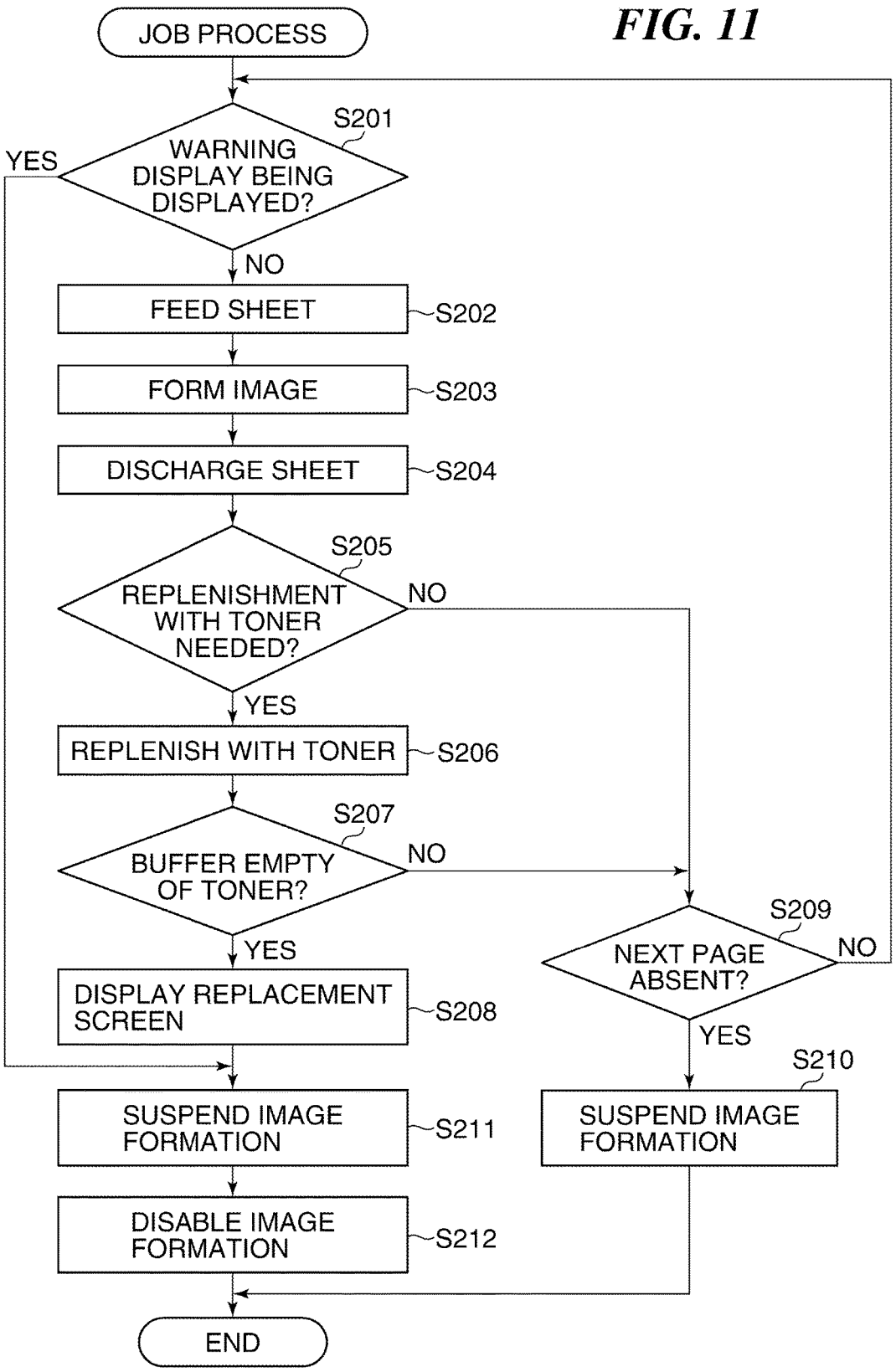
FIG. 11 is a flowchart of a job process.

FIG. 11 is a flowchart of a job process. This process is implemented by the CPU 400 reading programs stored in the ROM 401 into the RAM 402 and executing them. After the main power to the image forming apparatus 100 is turned on, the CPU 400 starts this process when an image forming job (print job) is submitted to the image forming apparatus 100. In the process in FIG. 11, the CPU 400 plays a role as a suspending unit of the present invention.

Since the warning screen (FIG. 9) is selectively displayed and hidden, an operation to display the warning screen does not synchronize to an image forming operation. Moreover, while the warning screen is being displayed, the image forming operation is not started because the image forming operation is disabled (step S212, to be described later). Referring to FIG. 11, a description will be given of a process in which in a case where the warning screen is displayed after the image forming operation is started, the image forming operation is disabled after a process to suspend the image forming operation is carried out.

First, after an image forming job is submitted and before feeding of sheets is started, the CPU 400 determines in step S201 whether or not the warning screen is being displayed. When the warning screen is being displayed, the CPU 400 carries out the process to suspend the image forming operation (step S211), disables the image forming operation (step S212), and ends the process in FIG. 11. The process to suspend the image forming operation is a process in which before the image forming operation is disabled, sheet discharging is completed without feeding new sheets, and further, operations such as conveyance involved in the image forming operation are suspended. Thus, when sheets remain in the image forming apparatus 100, the CPU 400 carries out a process to convey and discharge them.

As a result of the determination in the step S201, when the warning screen is not being displayed, the CPU 400 feeds a sheet stored in the sheet feeding cassette 110 by the pickup roller 111, the sheet feeding roller 112, and the retard roller 113. Next, in step S203, the CUP 400 forms an image on the fed sheet, and in step S204, the CPU 400 discharges the sheet to the discharged sheet tray 171 outside the image forming apparatus 100. Then, in step S205, the CPU 400 judges whether or not it is necessary to replenish the developing device 140 with toner. In the step S205, when the first toner sensor 221 outputs a signal indicating that there is toner in the developing device 140, the CPU 400 judges that it is unnecessary to replenish the developing device 140 with toner. When it is unnecessary to replenish the developing device 140 with toner, the image forming operation can be continued, and hence the process proceeds to step S209. In the step S209, the CPU 400 judges whether or not there is image data on a next page that should be subjected to image formation in this image forming job, and when the CPU 400 judges that there is image data on the next page that should be subjected to image formation, the process returns to the step S201. On the other hand, when the CPU 400 judges that there is no image data on the next page that should be subjected to image formation, it means that a printing process in the image forming job has been completed, and hence the CPU 400 carries out the process to suspend the image forming operation as with the step S211 and ends the process in FIG. 11.

In the step S205, when the first toner sensor 221 outputs a signal indicating that there is no toner in the developing device 140, the CPU 400 judges that it is necessary to replenish the developing device 140 with toner. When it is necessary to replenish the developing device 140 with toner, the process proceeds to step S206, in which the CPU 400 in turn rotates the screw 212 by controlling the motor 211 to perform a toner replenishing operation. Then, in step S207, the CPU 400 judges whether or not the buffer 210 is empty of toner based on the above described sequence of judgment (FIG. 6B) as to whether or not the buffer 210 is empty. When the CPU 400 judges that the buffer 210 is not empty of toner, the process proceeds to the step S209. On the other hand, when the CPU 400 judges that the buffer 210 is empty of toner, the process proceeds to step S208, in which the CPU 400 in turn displays the replacement screen (FIG. 8) on the operating unit 300, followed by the process proceeding to the step S211. Thus, when the buffer 210 becomes empty of toner during the image forming operation, the CPU 400 provides control to disable the image forming operation without sheets being fed and with sheet discharging completed.

It should be noted that in the job process according to the present embodiment, sheet feeding and sheet discharging are performed on a page-by-page basis, and after a fed sheet is discharged, a next sheet is fed. Thus, before each page is processed, it is determined whether or not the warning screen is being displayed (step S201). For this reason, as of the determination in the step S201, no sheet usually remains in the image forming apparatus 100, and therefore, the image forming apparatus 100 is able to quickly shift into the state where image formation is disabled. However, this is not limitative, but before discharging of a sheet is completed, a next sheet may be fed. In this case, the image forming apparatus 100 sequentially forms images on a plurality of sheets. In the step S204, the CPU 400 starts discharging a sheet, and in the next step S201, irrespective of whether or not the sheet has already been discharged, the CPU 400 determines whether or not the warning screen is being displayed before starting to feed a new sheet. When the warning screen is being displayed, the CPU 400 disables feeding of a new sheet and performs image formation on all sheets remaining in the conveying path 116, and after completing the image formation on all the sheets remaining in the conveying path 116, suspends the image forming operation. After all the sheets remaining in the conveying path 116 have been discharged, the image forming operation is suspended. It should be noted that when the toner bottle T that is not empty is re-mounted, and the warning screen is brought from the state of being displayed to the state of being hidden, the CPU 400 resumes the image forming operation so as to form images.

When it is judged that the toner bottle T is empty of toner while the steps S201 to S207 and S209 are repeated, the replaceable screen (FIG. 9) is displayed. This allows the user to replace the toner bottle T without suspending image formation.

According to the present embodiment, the CPU 400 displays the warning screen when the toner bottle T that is not empty has been replaced with another toner bottle T. After an image forming job is submitted, the CPU 400 judges whether or not the warning screen is being displayed, and when the warning screen is being displayed, provides control to disable an image forming operation without sheets being fed and with sheet discharging completed. Namely, when the toner bottle T that does not satisfy the replacement condition has been replaced with another toner bottle T, image formation is suspended after formation of images on sheets remaining in the conveying path 116 is completed. Therefore, in a case where container that is not empty of toner is replaced with another container, the image forming operation can be disabled without leaving sheets in the image forming apparatus 100. Namely, even when the toner bottle T that is not empty has been replaced with another toner bottle T, sheets are prevented from remaining in the image forming apparatus 100. Since no sheets remain in the image forming apparatus 100, it is unnecessary for the user to perform an operation to remove sheets from the image forming apparatus 100. Moreover, in response to re-mounting of the original toner bottle T, the warming screen is hidden, and the image forming operation is enabled, which enables the user to perform the image forming operation by re-mounting the original toner bottle T.

Second Embodiment

In the first embodiment, whether or not the warning screen is being displayed is judged with respect to each page in a print job. On the other hand, in a second embodiment of the present invention, whether or not the warning screen is being displayed is judged with respect to each job, not each page. By referring to FIG. 12 instead of FIG. 11, a description will be given of the present embodiment. Processes and arrangements in the second embodiment except for the job process are the same as those in the first embodiment.

Figure 12:
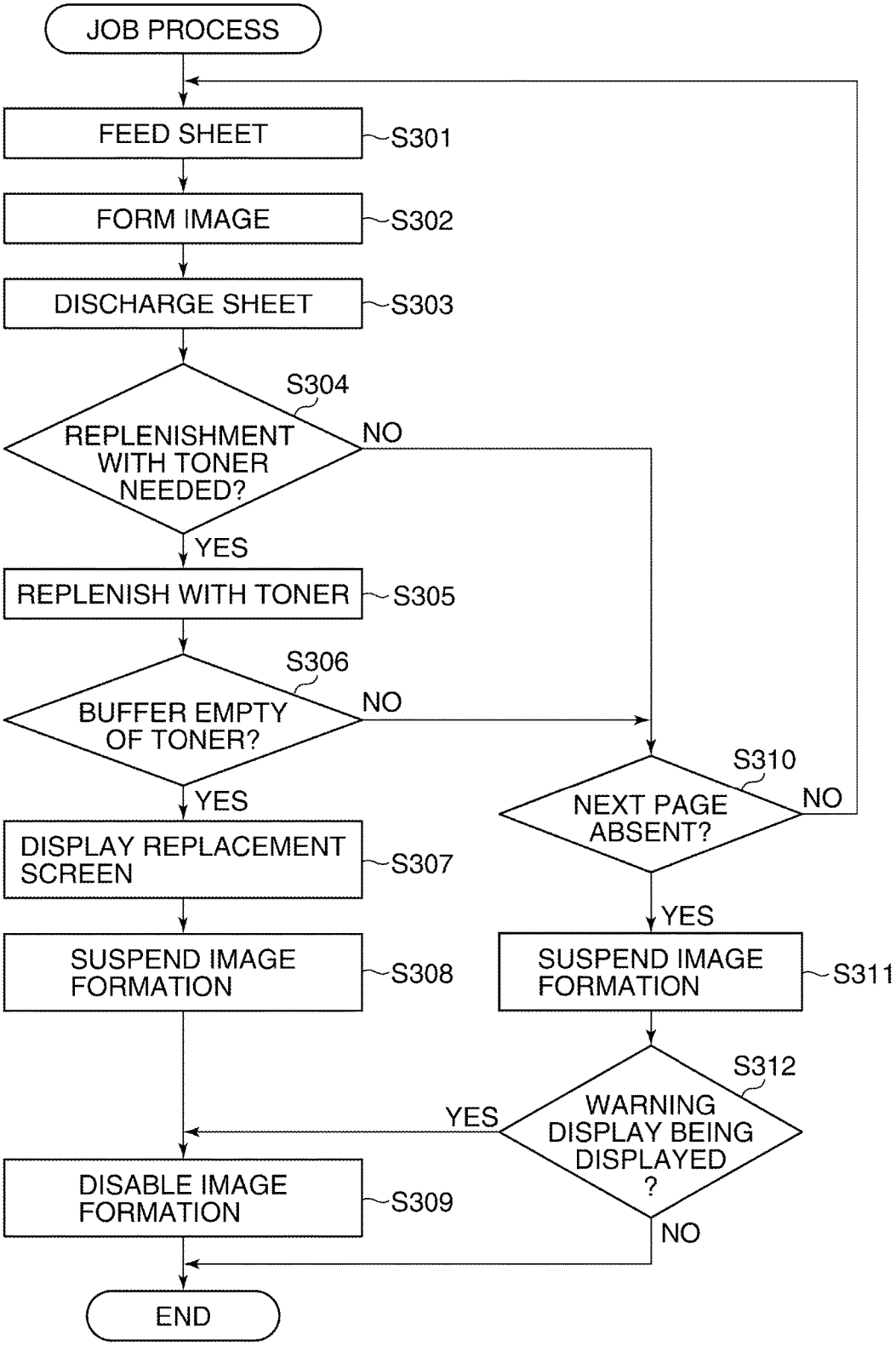
FIG. 12 is a flowchart of a job process.

FIG. 12 is a flowchart of a job process. This process is implemented by the CPU 400 reading programs stored in the ROM 401 into the RAM 402 and executing them. This process is started when an image forming job is submitted to the image forming apparatus 100 after the main power to the image forming apparatus 100 is turned on.

First, after the image forming job is submitted and before feeding of sheets is started, the CPU 400 carries out a process to feed a sheet stored in the sheet feeding cassette 110 by the pickup roller 111, the sheet feeding roller 112, and the retard roller 113. In subsequent steps S302 to S307, S310, and S311, the CPU 400 carries out the same processes as those in the steps S203 to S208, S209, and S210 in FIG. 11. It should be noted that as a result of the determination in the step S310, when there is image data on a next page that should be subjected to image formation in the present image forming job, the process returns to the step S301. After the step S307, the process proceeds to step S308, in which the CPU 400 in turn carries out the process to suspend the image forming operation as with the step S211, followed by the process proceeding to step S309. After the step S311, the process proceeds to step S312, in which the CPU 400 in turn determines whether or not the warning screen is being displayed, and when the warning screen is not being displayed, the CPU 400 ends the process in FIG. 12. On the other hand, when the CPU 400 determines that the warning screen is being displayed, the process proceeds to the step S309. In the step S309, the CPU 400 disables the image forming operation and ends the process in FIG. 12.

According to the present embodiment, when a container (toner bottle T) that is not empty is replaced with another container, the image forming operation is disabled without leaving sheets in the image forming apparatus 100, the same effects as those in the first embodiment are obtained. Moreover, the image forming operation is enabled by putting the toner bottle T back.

It should be noted that in the present embodiment, when a plurality of print jobs are continuously submitted, the image forming operation may be suspended at breaks between the print jobs. In this case, for example, job ID information is assigned to image data with respect to each of the print jobs, and the CPU 400 determines the breaks between the print jobs based on changes in the job ID information. Then, at the breaks between the print jobs, the CPU 400 may suspend the image forming operation and then disable the image forming operation as long as the warning screen is being displayed. Accordingly, after completing each print job, the CPU 400 determines whether or not the warning screen is being displayed. When the warning screen is being displayed, and there is a subsequent print job, the CPU 400 provides control to disable the image forming operation before starting the subsequent print job.

It should be noted that in the step S108 in FIG. 10, the warning screen (FIG. 9) is displayed which is an example of a notification. However, this notification may be in any form and has only to be a notification for prompting re-mounting of the toner bottle T that is not empty and has been removed once. Therefore, a notification using sound instead of a screen may be adopted.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-188362, filed Sep. 28, 2017 which is hereby incorporated by reference herein in its entirety.

What is claimed is:

1. An image forming apparatus comprising:

a conveying unit configured to feed a sheet to convey the sheet along a conveying path;

an image forming unit configured to form an image on the sheet using a developer;

a mount to which a container is mounted, the container containing the developer;

a replenishing unit configured to replenish the image forming unit with the developer from the mounted container;

a controller configured to judge whether or not replacement of the mounted container is necessary, and in a case where the mounted container is replaced with another one without replacement of the container necessary during image formation operation by the image forming unit, (i) suspend feeding of the sheet by the conveying unit, (ii) discharge the sheet remaining in the conveying path, and (iii) disable an image forming operation of the image forming unit; and a display configured to display a screen for prompting replacement of the mounted container if replacement of the container is necessary, and display a screen for prompting re-mounting of the replaced container in a case where the mounted container is replaced with another one without replacement of the container necessary.

2. The image forming apparatus according to claim 1, wherein the image forming unit forms the image on the sheet remaining in the conveying path before the controller disables the image forming operation, in a case where the mounted container is replaced with another one without replacement of the mounted container necessary during the image forming operation by the image forming unit.

3. The image forming apparatus according to claim 1, further comprising a sensor configured to detect the developer in the image forming unit, wherein the controller carries out a replenishing process in a case where the sensor detects the developer in the image forming unit, and the controller judges that replacement of the mounted container is necessary in a case where the replenishing process is carried out by a predetermined number of turns without the sensor detecting the developer in the image forming unit.

4. The image forming apparatus according to claim 1, wherein the controller causes the image forming unit to resume the image forming operation in a case where the image forming unit is re-mounted with a screen for prompting re-mounting of the replaced container being displaced on the display.

5. The image forming apparatus according to claim 1, wherein the display displays another screen in a case where the replaced container is re-mounted with a screen for prompting re-mounting of the replaced container being displaced on the display.

6. The image forming apparatus according to claim 1, wherein the display hides the screen for prompting re-mounting of the replaced container in a case where the replaced container is re-mounted with a screen for prompting re-mounting of the replaced container being displaced on the display.

7. The image forming apparatus according to claim 1, further comprising a reader configured to read identification information of the container mounted in the mount, wherein the controller judges whether or not the mounted container is replaced, based on the identification information read by the reader.

8. The image forming apparatus according to claim 1, further comprising a sensor configured to detect the developer in the image forming unit, wherein the image forming unit enables the image forming operation until the sensor does not detect the developer in the image forming unit in a case where the container has been removed from the container.

9. The image forming apparatus according to claim 1, further comprising a sensor configured to detect the developer in the image forming unit, wherein the display displays a screen for prompting mounting of the container on the mount in a case where the sensor has not detected the developer in the image forming unit with the container removed from the mount.

10. The image forming apparatus according to claim 1, wherein the controller causes the image forming unit not to suspend the image forming operation even if the mounted container is removed without replacement of the container necessary during image formation operation by the image forming unit.

11. The image forming apparatus according to claim 1, wherein the display does not display the screen for prompting mounting of the replaced container even if the mounted container is removed without replacement of the container necessary during image formation operation by the image forming unit.

* * * * *